US005882185A

United States Patent [19]

Kim

[11] Patent Number: 5,882,185

[45] Date of Patent: Mar. 16, 1999

[54] APPARATUS FOR DETECTING A HEAD WIND IN A GAS BOILER AND METHOD THEREOF

[75] Inventor: Si-Hwan Kim, Seoul, Rep. of Korea

[73] Assignee: Daewoo Electronics Co., Ltd., Seoul, Rep. of Korea

[21] Appl. No.: 721,344

[22] Filed: Sep. 26, 1996

[30] Foreign Application Priority Data

Sep. 27, 1995 [KR] Rep. of Korea ..... 1995 32184

[51] Int. Cl.[6] ..... F23N 3/00

[52] U.S. Cl. ..... 431/20; 126/110 R; 126/110 A; 126/116 R

[58] Field of Search ..... 431/20; 126/110 R, 126/110 A, 116 R

[56] References Cited

U.S. PATENT DOCUMENTS

| | | | |
|---|---|---|---|
| 4,059,385 | 11/1977 | Gulitz et al. | 431/12 |
| 4,330,260 | 5/1982 | Jorgenson et al. | 431/12 |
| 4,688,547 | 8/1987 | Ballard et al. | 126/116 A |
| 4,712,996 | 12/1987 | Adams et al. | 431/20 |
| 4,951,651 | 8/1990 | Shellenberger | 126/116 R |
| 5,019,757 | 5/1991 | Beifus | 318/254 |
| 5,222,888 | 6/1993 | Jones et al. | 431/20 |
| 5,331,944 | 7/1994 | Kujawa et al. | 126/110 R |
| 5,612,904 | 3/1997 | Bunting | 365/551.01 |
| 5,720,231 | 2/1998 | Rowlette et al. | 110/162 |

*Primary Examiner*—Larry Jones

*Attorney, Agent, or Firm*—Beveridge, DeGrandi, Weilacher & Young LLP

[57] ABSTRACT

An apparatus for detecting a head wind in a gas boiler and method is disclosed which is capable of the magnitude of variation of voltage corresponding to the R.P.M. of an exhaust fan and the combustion state of flame. A microcomputer in the gas boiler detects the R.P.M of exhaust fan and voltage applied to the exhaust fan when the R.P.M exceeds a normal limit. The detected voltage is compared with a reference voltage. If the compared result exceeds a predetermined value, to sense the combustion state of flame an infrared rays sensor is used. When the head wind is introduced into an exhaust conduit, the red wavelength is sensed at flame due to incomplete combustion. Accordingly, in case that the magnitude of variation of voltage exceeds a predetermined value and the red wavelength is sensed, microcomputer can detect the head wind.

7 Claims, 3 Drawing Sheets

APPARATUS FOR DETECTING A HEAD WIND IN A GAS BOILER AND METHOD THEREOF

BACKGROUND OF THE INVENTION

1. Field of the Invention

The present invention relates to an apparatus for detecting a head wind in a gas boiler and a method thereof. More particularly, the present invention relates to a detecting method and a detecting apparatus capable of performing the detecting method for detecting a head wind introduced in a gas boiler according to the magnitude of variation of voltage corresponding to the R.P.M.(rotation per minute) of an exhaust fan and the combustion state of flame.

2. Prior Arts

In general, boilers are classified into a gas boiler and an oil boiler according to a fuel to be used. Especially, because the gas boiler uses gas as the fuel, it does not generate waste gas which contaminates environment in comparison with the oil boiler. Accordingly, it has been widely used in many housings or apartments.

However, there frequently generates a problem in a conventional gas boiler which the operation of gas boiler is stopped by the head wind introduced through an exhaust conduit. The head wind has an effect upon the operation of gas boiler and prevents the discharge of exhaust gas which is generated by the combustion of gas to thereby introduce the exhaust gas into the room. Especially, if the harmful exhaust gas generated by the incomplete combustion of gas is introduced into the room, it causes the human body to be deadly damaged.

Accordingly, various type of apparatuses and methods for detecting the head wind have been proposed and used.

Referring to FIG. 1, a conventional apparatus for detecting a head wind is described thereunder.

As shown in FIG. 1, the conventional apparatus for detecting the head wind has an exhaust fan housing 2 which an inflow port 1 is formed on one side thereof, an exhaust fan 4 connected to a motor 3 of exhaust fan housing 2, an exhaust conduit 6 connected to exhaust port 5 for exhausting a combustion gas introduced by exhaust fan 4, a head wind detecting plate 7 for swinging according to head wind introduced through exhaust conduit 6, and a head wind detecting rod 10 for rotating round a hinge 8 as a center according to the swing state of head wind detecting plate 7 and turning on/off a microswitch 9 attached to motor 3 to supply/cut off the power source to gas boiler.

The operation of conventional apparatus with above construction will be described in detail thereunder.

The gas boiler is turned on according to the user's command or a specific condition. Then, motor 3 is rotated, and exhaust fan 4 mounted on the axis of motor is rotated and intakes the remained combustion gas or air in a combustor of gas boiler. The combustion gas or air upwardly pulls head wind detecting plate 7 through exhaust port 5 formed in exhaust fan housing 2 and is exhausted to exhaust conduit 6.

Then, the head wind detecting rod 10 attached to head wind detecting plate 7 swings round hinge 8 as a center and turns on microswitch 9 connected to motor 3. Therefore, an igniter of gas boiler flames out and ignites the supplied gas. However, if the strong head wind is introduced along exhaust conduit 6 during ignition, head wind detecting plate 7 is downwardly pulled. Then, head wind detecting rod 10 swings round hinge 8 as a center and turns off microswitch 9 attached to motor 3. If this state is maintained during a predetermined period, the gas valve of gas boiler is cut off and the operation of gas boiler is stopped.

However, the conventional apparatus for detecting a head wind makes the operation of gas boiler be often discontinued by temporary and strong head wind. Also, if the above apparatus is used during long-term period, the accuracy is lowered.

As another conventional apparatus, there is an apparatus for detecting a head wind which measures the R.P.M. (rotation per minute) of exhaust fan and determines whether the head wind is introduced. The apparatus sets the standard R.P.M. in accordance with an applied voltage, measures the R.P.M. of exhaust fan during operation of gas boiler, and detects whether the head wind is introduced. That is, when the difference between the R.P.M. of normal exhaust state and that of measured exhaust state is more than a predetermined value, it is determined that the head wind is introduced (if the head wind is introduced, the movement of exhaust gas is stopped and the resistance is reduced to thereby increase the R.P.M. of the exhaust fan).

However, because the introduction of head wind is only sensed by the R.P.M. of exhaust fan, when the power supply applied to the exhaust fan is varied, it is recognized for the head wind to be introduced and the operation of gas boiler is stopped.

SUMMARY OF THE INVENTION

Accordingly, it is an object of the present invention to provide a method capable of detecting a head wind introduced into a gas boiler according to the magnitude of variation of voltage corresponding to the R.P.M. of exhaust fan and the combustion state of flame.

Another object of the present invention is to provide an apparatus which is suitable for carrying out the above detecting method.

To accomplish the above object of the present invention, there is provided a method for detecting a head wind in a gas boiler comprising the steps of:

a) detecting a R.P.M. of an exhaust fan;

b) comparing a voltage applied to the exhaust fan and a reference voltage when the R.P.M. exceeds a normal limit;

c) carrying out a normal operation when the compared difference is less than a predetermined value, and sensing a combustion state of flame when the compared difference is more than the predetermined value; and d) stopping the combustion of a gas burner when incomplete combustion is sensed.

To accomplish the above another object of the present invention, there is provided an apparatus for detecting a head wind, said apparatus comprising:

a transformer for transforming an input voltage into a voltage with a predetermined magnitude;

a rectifier for rectifying the transformed voltage a sensing means for sensing a combustion state of flame in a gas burner;

a detecting means for detecting a R.P.M. of an exhaust fan; and a microcomputer 15 for determining whether the R.P.M of the exhaust fan is within a normal limit, comparing the rectified voltage and a reference voltage when the R.P.M exceeds within the normal limit, determining the introduction of head wind according to the combustion state of flame sensed by said sensing means when a difference between the rectified voltage and the reference voltage is more than a predetermined value.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

Hereinafter, the present invention will be explained in details with reference to the accompanying drawing.

Figure 1:
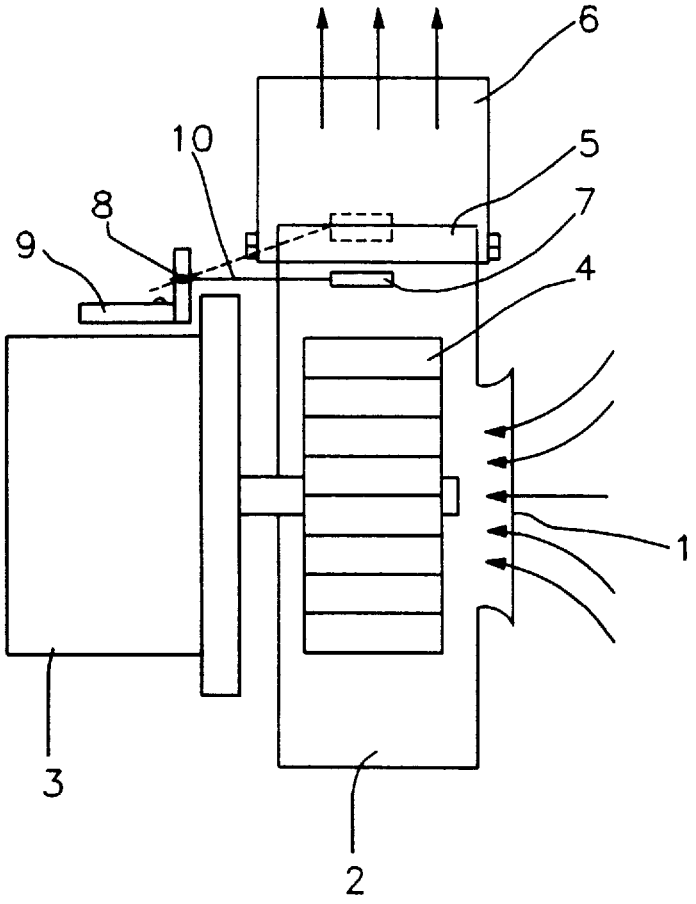
FIG. 1 PRIOR ART
FIG. 1 is a schematic diagram showing a conventional apparatus for detecting a head wind in a gas boiler.
Figure 2:
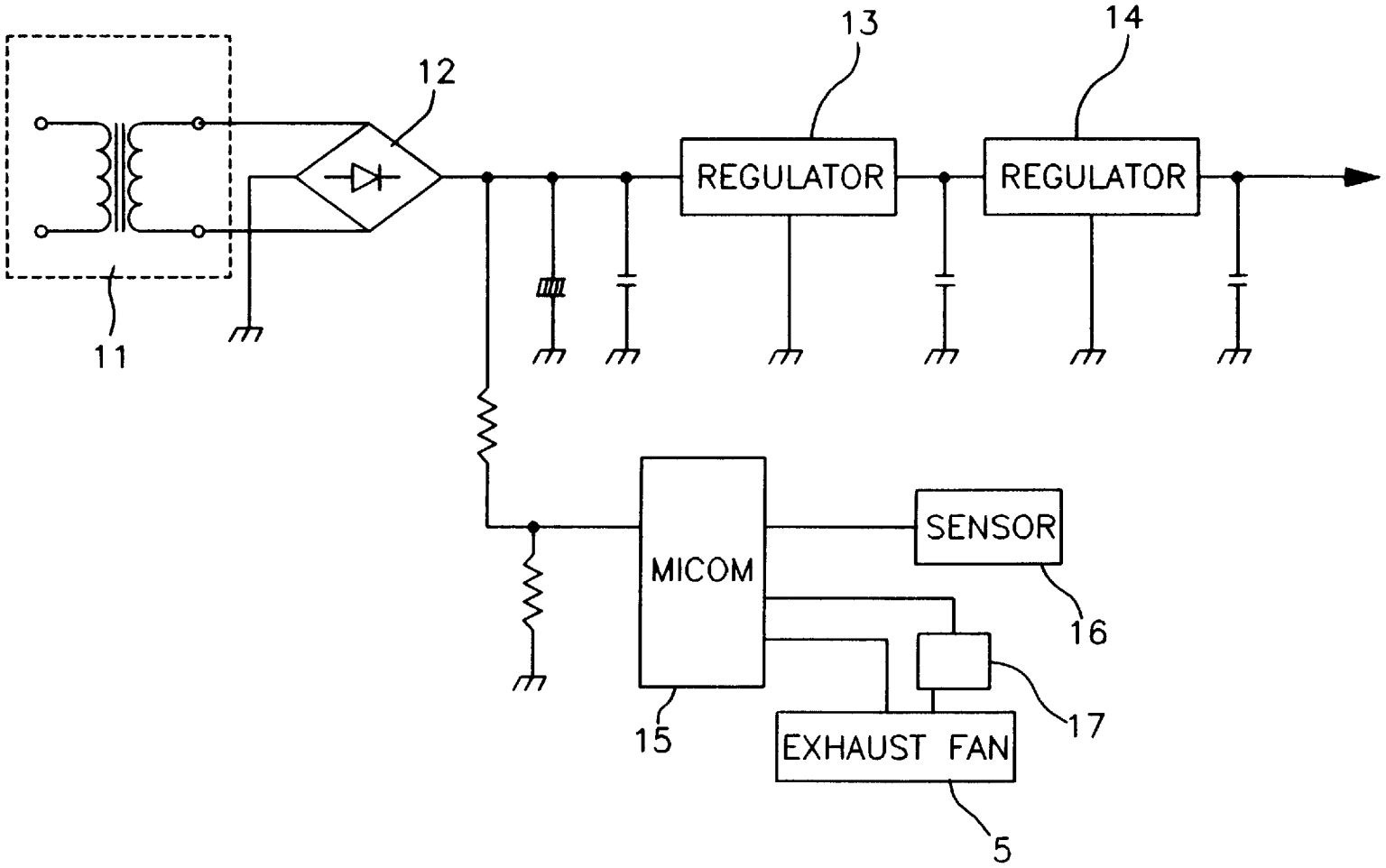
FIG. 2 is a schematic diagram showing a construction of an apparatus for detecting a head wind according to one embodiment of the present invention.
Figure 3:
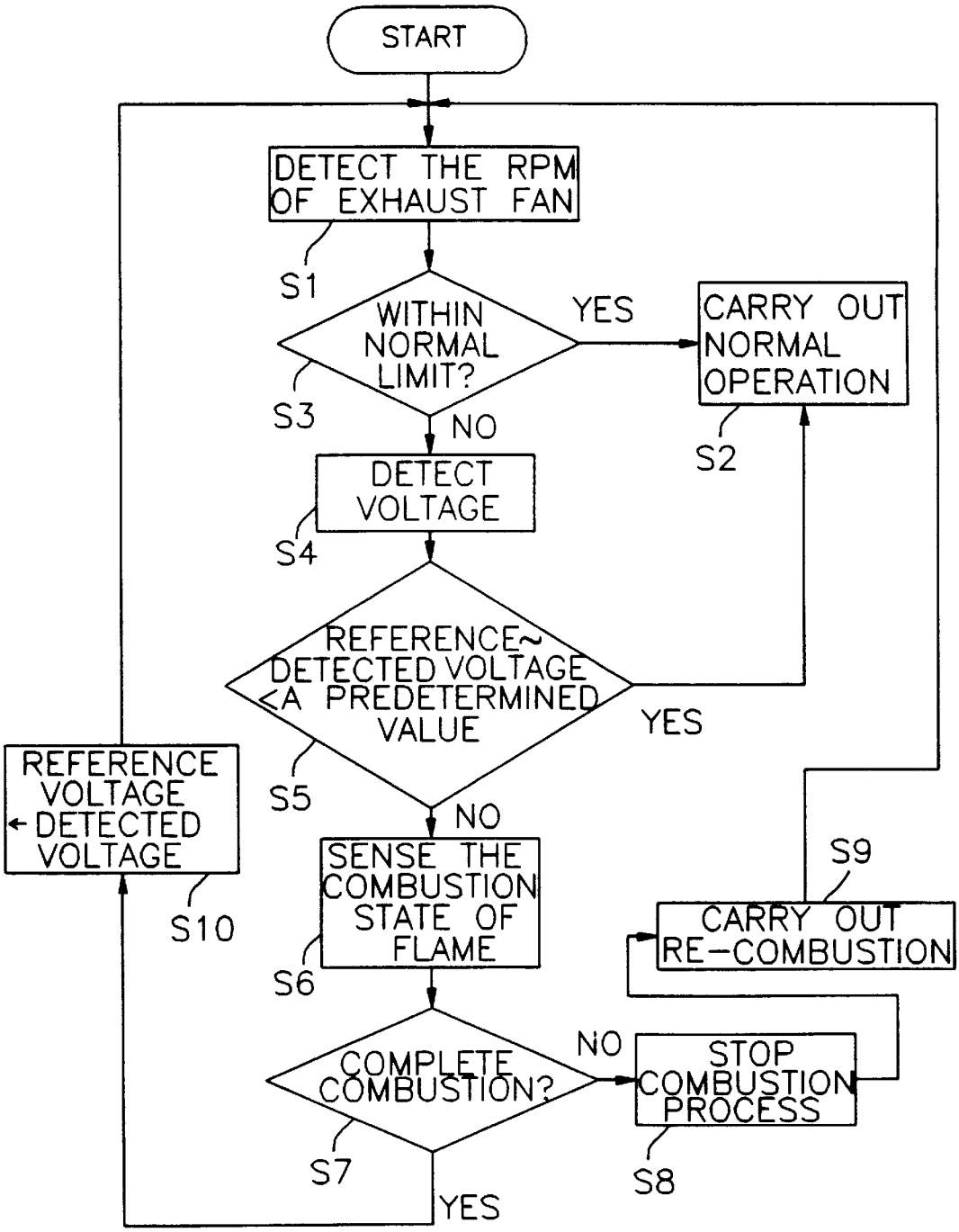
FIG. 3 is a flow chart for schematically illustrating a method for detecting a head wind in accordance with one embodiment of the present invention.

FIG. 2 is a schematic diagram showing a construction of an apparatus for detecting a head wind according to one embodiment of the present invention and FIG. 3 is a flow chart for schematically illustrating a method for detecting a head wind in accordance with one embodiment of the present invention.

Referring to FIGS. 2 and 3, apparatus for detecting a head wind and method thereof will be explained in details as follows. As shown in FIG. 2, the apparatus for detecting a head wind in a gas boiler according to one embodiment of the present invention has a transformer 11 for transforming a voltage input from the external into a voltage having a predetermined magnitude, a rectifier 12 for rectifying the transformed voltage, a pair of regulator 13, 14 for regulating the rectified voltage and supplying several parts of gas boiler with stable voltage, a sensor 16 for sensing the state of flame combusted in a gas burner, a hall sensor 17 for detecting the R.P.M. of exhaust fan, and microcomputer 15 for determining whether the head wind is introduced according to the magnitude of variation of voltage corresponding to the R.P.M.(rotation per minute) of an exhaust fan and the combustion state of flame.

When the user's command is inputted to microcomputer 15 or the specific condition is satisfied, the gas boiler operates according to the preinstalled program. After the operation of gas boiler, microcomputer 15 detects the R.P.M. of exhaust fan ($S_1$).

The detected R.P.M. is compared with the previous set reference R.P.M. ($S_2$). According to the difference between them, microcomputer 15 determines whether the difference is within normal limit. The detection of R.E.M. is made by a magnet mounted on exhaust fan and a hall sensor 16 placed on exhaust conduit 6 for sensing a polarity of magnet.

In $S_2$ step, when the difference exists within normal limit, the normal operation is carries out ($S_3$). Otherwise, the process proceeds to $S_4$ step. In S4 step, when the detected R.P.M. deviates normal limit, microcomputer 15 detects a voltage applied to the exhaust fan and determines whether the variation of voltage causes the R.P.M. of exhaust fan to be changed. This voltage is outputted from transformer 11. Transformer 11 transforms a voltage applied to the input terminal into voltage with a predetermined magnitude. For example, when the voltage applied to the input terminal is AC 220V, the output voltage is AC 12V. This voltage is rectified by rectifier 12. For example, the rectified voltage is DC 5V. A bridge rectifier is used as rectifier. However, because the rectified voltage is unstable, in order to make the voltage stable, a pair of regulators are used and the voltage processed by regulators is supplied to several parts of gas boiler.

The rectified voltage is inputted to microcomputer 15. The voltage which is measured at microcomputer 15 is 0 to 5V. For example, when the measured voltage is 4V, input voltage is 220V. Also, when the measured voltage 4.15V, input voltage is 230V. Above values may be changed according to the kind of boiler or exhaust fan. Microcomputer 15 has a built-in A/D converter and converts analog-input voltage into digital voltage.

After detecting the voltage, microcomputer 15 determines which the difference between the detected voltage and reference voltage is less than a predetermined value ($S_5$). When the difference is less than the predetermined value, it represents simple variation of voltage and does not means the introduction of head wind. Accordingly, the process proceeds to $S_3$ step and the normal operation of gas boiler is maintained.

However, if the difference is more than the predetermined value, it represents that the internal or external cause exists. The internal cause is a case that the gas boiler operates in condition which is different from initial condition and external cause is introduction of head wind. Especially, if the variation of voltage is made by the internal cause, it changes the R.P.M. of exhaust fan, but does not have an effect on the combustion. Accordingly, it is very difficult to determine the introduction of head wind by the variation of voltage However, if the variation of voltage is made by the introduction of head wind, it exerts a bad influence upon combustion of gas burner. To clarify the cause of variation of voltage, the present invention uses a sensor 16 for sensing the state of flame of gas burner ($S_6$). The present invention uses a infrared rays sensor 16 as a sensor. As above-described, because the variation of voltage by internal cause exerts influence on the R.P.M. of exhaust fan, but does not exert influence upon the combustion state of gas burner. On the contrary, the introduction of head wind has effect on the R.P.M. of exhaust fan and the combustion state of gas burner.

Accordingly, infrared rays sensor 16 senses the state of flame and microcomputer 15 determines incomplete combustion or complete combustion according to the combustion state of flame ($S_7$). In case of incomplete combustion, because the color of flame ignited in gas burner is red, infrared rays sensor 16 senses red wavelength of infrared rays. The sensed signal is transmitted to microcomputer 15.

When a voltage signal representing complete combustion is inputted into microcomputer 15, the detected voltage is set and stored as a reference voltage ($S_{10}$). On the basis of new set reference voltage, the variation of voltage or introduction of head wind will be determined.

However, if the voltage signal representing incomplete combustion is inputted, micromputer 15 makes the gas boiler stop the combustion process and be converted into stand-by status ($S_8$). When the R.P.M. of exhaust fan is reduced less than a predetermined value, it carries out re-combustion operation ($S_9$). After re-combustion, $S_1$ to $S_9$ steps are iterated.

As above-described, apparatus for detecting a head wind in a gas boiler and method thereof according the present invention consider the R.P.M. of exhaust fan, the magnitude of variation of voltage and the combustion state of flame and can precisely detect the introduction of head wind to thereby safely use the gas boiler.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. An apparatus for detecting a head wind in a gas boiler, said apparatus comprising:

a transformer for transforming an alternating current voltage inputted from exterior;

a rectifier for rectifying an alternating current which is inputted from the transformer to thereby generate a direct current, and for providing the direct current to a motor driving an exhaust fan;

a sensing means for sensing a combustion state of a flame in a gas boiler;

means for providing a reference voltage source for the exhaust fan when said exhaust fan is operating within a predetermined normal limit of R.P.M.

a detecting means for detecting an R.P.M. of the exhaust fan; and a microcomputer for determining whether the R.P.M. of the exhaust fan is within said predetermined normal limit, comparing the rectified voltage with the reference voltage when the R.P.M. exceeds the normal limit and, determining an introduction of the head wind based on the combustion state of the flame sensed by said sensing means when a difference between the rectified voltage and the reference voltage is more than the predetermined normal limit.

2. The apparatus as claimed in claim 1, wherein said sensing means is an infrared rays sensor and said sensor senses a red wavelength of infrared rays.

3. The apparatus as claimed in claim 1, wherein said detecting means comprises a magnet mounted on the exhaust fan; and a hall sensor placed on an exhaust conduit for sensing a polarity of the magnet.

4. A method for detecting a head wind in a gas boiler comprising the steps of:

a) determining a reference voltage for an exhaust fan of said gas boiler when said fan is operating within a predetermined normal limit of R.P.M.

b) detecting an R.P.M. of the exhaust fan of said gas boiler;

c) comparing a voltage applied to the exhaust fan with the reference voltage when the R.P.M. of said exhaust fan exceeds the normal limit;

d) carrying out a normal operation when the compared difference is less than a predetermined value, sensing a combustion state of a flame of the gas boiler when the compared voltage difference obtained by the step c)is more than the predetermined normal limit; and e determining an introduction of head wind based on the combustion state of the flame sensed by step d).

5. The method as claimed in claim 4, wherein said sensing of the combustion state of the flame is made by an infrared rays sensor.

6. The method as claimed in claim 5, wherein said infrared rays sensor senses a red wavelength of the infrared rays.

7. An apparatus for detecting a head wind which is generated in a furnace of a gas boiler, the gas boiler including an exhaust fan which is installed in the furnace for exhausting combustion products, and the exhaust fan is rotated by a motor, the apparatus comprising:

a current source for providing a current to the motor to drive the exhaust fan;

an infrared rays sensor for sensing infrared rays radiated from the furnace and generating a sensing signal corresponding to an intensity of the infrared rays;

means for evaluating a rotation velocity of the exhaust fan;

means for determining whether the rotation velocity of the exhaust fan is within a predetermined range;

means for comparing a voltage of the current being provided to the motor with a reference voltage which is generated from a reference voltage source when the rotation velocity of the exhaust fan exceeds the predetermined range; and means for determining whether the head wind is generated based on the intensity of the radiated infrared rays and the result of the means comparing the voltages.

* * * * *